US007686574B1

(12) United States Patent
Airosa et al.

(10) Patent No.: US 7,686,574 B1
(45) Date of Patent: Mar. 30, 2010

(54) CENTRIFUGAL IMPELLER/PROPELLER PUMP SYSTEM

(76) Inventors: Frank L. Airosa, 2173 Zumwalt, Tulare, CA (US) 93274; Brad D. Myrick, 1501 Boyer Dr., Tulare, CA (US) 93274

( * ) Notice: Subject to any disclaimer, the term of this patent is extended or adjusted under 35 U.S.C. 154(b) by 310 days.

(21) Appl. No.: 11/893,488

(22) Filed: Aug. 16, 2007

Related U.S. Application Data

(60) Provisional application No. 60/931,799, filed on May 25, 2007.

(51) Int. Cl.
*F03B 11/08* (2006.01)

(52) U.S. Cl. ..... 415/121.1; 415/143; 415/214.1; 416/185

(58) Field of Classification Search ..... 415/121.1, 415/143, 206, 214.1; 416/185, 198 R, 203
See application file for complete search history.

(56) References Cited

U.S. PATENT DOCUMENTS 1,675,200 A * 6/1928 Smith ..... 210/416.1
3,211,101 A * 10/1965 Ashworth et al. ..... 415/111
3,467,302 A * 9/1969 Wilson ..... 416/20 R
3,796,511 A * 3/1974 Hansen ..... 415/144
5,253,812 A 10/1993 Staples
5,256,032 A * 10/1993 Dorsch ..... 415/121.1
5,711,789 A * 1/1998 Elonen et al. ..... 96/216
5,858,228 A 1/1999 Turchetti
6,073,305 A * 6/2000 Hesskamp ..... 15/405
6,447,245 B1 * 9/2002 Oakley et al. ..... 415/121.1
6,461,121 B1 * 10/2002 Lelong ..... 417/423.1
6,789,999 B2 * 9/2004 Bikos et al. ..... 415/98
6,878,280 B2 4/2005 McDowell
6,942,448 B1 9/2005 Pemberton
7,080,797 B2 * 7/2006 Doering et al. ..... 241/46.08
2004/0234370 A1 * 11/2004 Simakaski et al. ..... 415/121.1
2006/0263210 A1 * 11/2006 Wang ..... 415/206

* cited by examiner

*Primary Examiner*—Edward Look
*Assistant Examiner*—Aaron R Eastman

(57) ABSTRACT

A housing includes a major component. The major component has a planar section. The planar section has an aperture constituting an inlet. The major component has a generally cylindrical peripheral section. A tangential extension is provided. The aperture constitutes an outlet. The housing also includes a minor component. The minor component has a planar section. The planar section has an aperture. The aperture constitutes an outlet. A tangential extension is adapted to overlie the major component for creating a chamber. A rotatable assembly includes an annular plate. The annular plate has an aperture. Spaced impeller segments are provided. A propeller is also provided. The propeller has an axial bore. Propeller blades are provided. Openings are provided between the blades. The bore is adapted to receive a drive shaft of a motor. In this manner the propeller and the annular plate and the impeller segments are rotated.

2 Claims, 3 Drawing Sheets

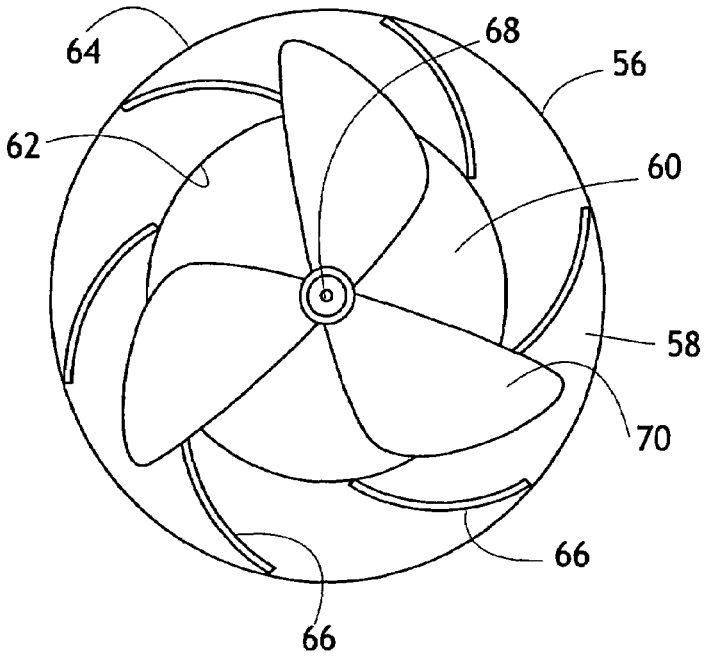
FIG. 1
FIG. 2
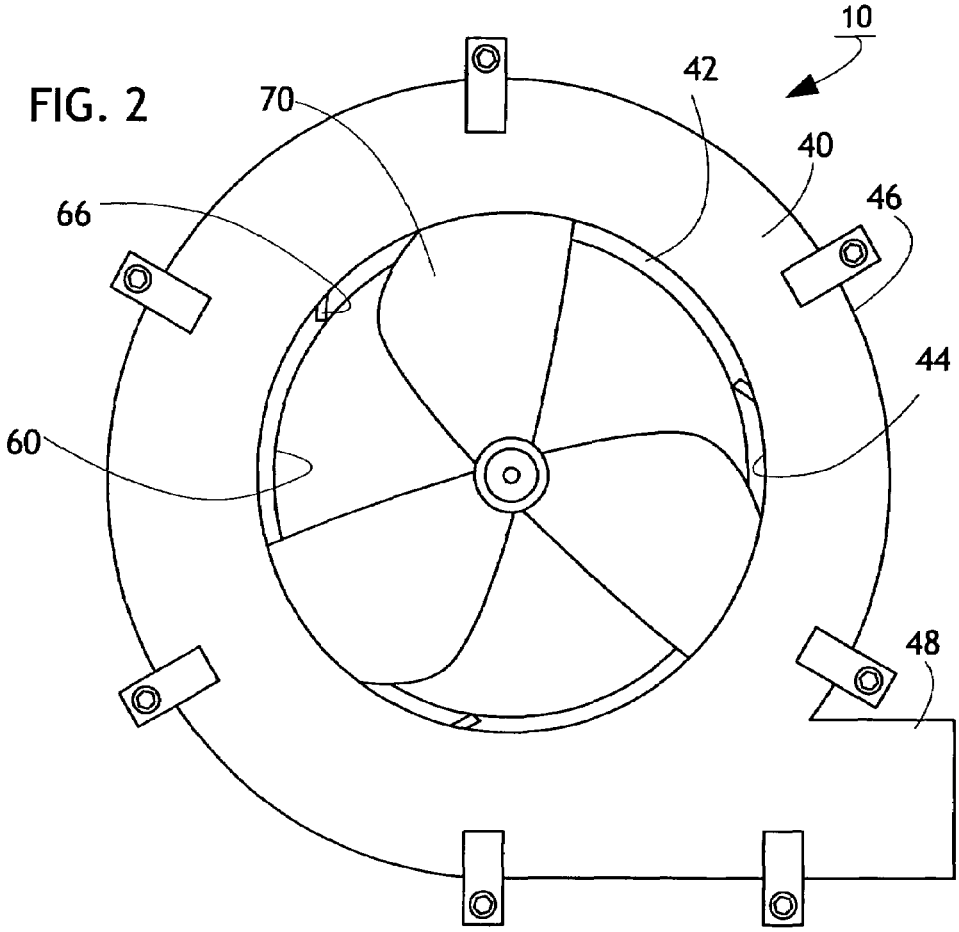

CENTRIFUGAL IMPELLER/PROPELLER PUMP SYSTEM

RELATED APPLICATION

The present U.S. non-provisional Patent Application is based upon U.S. provisional Patent Application Ser. No. 60/931,799 filed May 25, 2007, the subject matter of which is incorporated herein by reference.

BACKGROUND OF THE INVENTION

1. Field of the Invention

The present invention relates to a centrifugal impeller/propeller pump system and more particularly pertains to pumping liquids with suspended solids in a safe, efficient and economical manner.

2. Description of the Prior Art

The use of pump systems of known designs and configurations is known in the prior art. More specifically, pump systems of known designs and configurations previously devised and utilized for the purpose of pumping liquids through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,942,448 issued Sep. 13, 2005 to Pemberton relates to a Pump. U.S. Pat. No. 6,878,280 issued Apr. 12, 2005 to McDowell relates to Wastewater Clarification Methods and Apparatus. U.S. Pat. No. 5,858,228 issued Jan. 12, 1999 to Turchetti relates to a Separation Filter with Turbine Generating Controlled Turbulence for Solids Suspended in Liquids. Lastly, U.S. Pat. No. 5,253,812 issued Oct. 19, 1993 to Staples relates to a Tank Cleaning Method and Apparatus.

While these devices fulfill their respective, particular objectives and requirements, the aforementioned patents do not describe a centrifugal impeller/propeller pump system that allows for pumping liquids with suspended solids in a safe, efficient and economical manner.

In this respect, the centrifugal impeller/propeller pump system according to the present invention substantially departs from the conventional concepts and designs of the prior art, and in doing so provides an apparatus primarily developed for the purpose of pumping liquids with suspended solids in a safe, efficient and economical manner.

Therefore, it can be appreciated that there exists a continuing need for a new and improved centrifugal impeller/propeller pump system which can be used for pumping liquids with suspended solids in a safe, efficient and economical manner. In this regard, the present invention substantially fulfills this need.

SUMMARY OF THE INVENTION

In view of the foregoing disadvantages inherent in the known types of pump systems of known designs and configurations now present in the prior art, the present invention provides an improved centrifugal impeller/propeller pump system. As such, the general purpose of the present invention, which will be described subsequently in greater detail, is to provide a new and improved centrifugal impeller/propeller pump system and method which has all the advantages of the prior art and none of the disadvantages.

To attain this, the present invention essentially comprises a centrifugal impeller/propeller pump system. First provided is a housing. The housing includes a major component. The major component has a planar section. The planar section has a circular aperture. In this manner a radially interior periphery and a radially exterior periphery are formed. The major component also has a generally cylindrical peripheral section. The peripheral section has an axially interior edge. The interior edge is secured to the exterior periphery. The peripheral section also has a free axially exterior edge. The peripheral section and the planar section have a tangential extension. In this manner an outlet is created.

The housing also includes a minor component. The minor component has a planar section. The planar section has a circular aperture. The circular aperture constitutes an outlet. Also in this manner a radially interior periphery and a radially exterior periphery are formed. The planar section has a tangential extension. In this manner the exterior periphery of the minor section is adapted to overlie the axially exterior edge of the of the major component. Further in this manner a generally cylindrical chamber is created between the major and minor components. Bolts are provided. Nuts are also provided. The bolts and nuts secure the major and minor components during operation and use.

Provided last is a rotatable assembly. The rotatable assembly includes an annular plate. The annular plate is positioned within the chamber adjacent the planar surface of the major component. The annular plate has a generally circular aperture. In this manner a radially interior periphery and a radially exterior periphery are formed. The annular plate has six arcuately shaped outstanding spaced impeller segments. The impeller segments are located within the chamber. The annular plate also has a propeller. The propeller has an axial bore. The propeller has three spaced propeller blades. Openings are provided between the blades. The propeller blades are located partially interior of the chamber and partially exterior of the chamber. The propeller blades extend through the circular aperture of the planar section of the minor component. The bore is adapted to receive a drive shaft of a motor. In this manner the propeller and the annular plate and the impeller segments are rotated. Further in this manner water will be drawn into the chamber through the aperture of the major component into contact with the impeller segments and the expelled from the chamber through the peripheral extension and exit.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved centrifugal impeller/propeller pump system which has all of the advantages of the prior art pump systems of known designs and configurations and none of the disadvantages.

It is another object of the present invention to provide a new and improved centrifugal impeller/propeller pump system which may be easily and efficiently manufactured and marketed.

It is further object of the present invention to provide a new and improved centrifugal impeller/propeller pump system which is of durable and reliable constructions.

An even further object of the present invention is to provide a new and improved centrifugal impeller/propeller pump system which is susceptible of a low cost of manufacture with regard to both materials and labor, and which accordingly is then susceptible of low prices of sale to the consuming public, thereby making such centrifugal impeller/propeller pump system economically available to the buying public.

Even still another object of the present invention is to provide a centrifugal impeller/propeller pump system for pumping liquids with suspended solids in a safe, efficient and economical manner.

Lastly, it is an object of the present invention to provide a new and improved centrifugal impeller/propeller pump system. A housing includes a major component. The major component has a planar section. The planar section has an aperture constituting an inlet. The major component has a generally cylindrical peripheral section. A tangential extension is provided. The aperture constitutes an outlet. The housing also includes a minor component. The minor component has a planar section. The planar section has an aperture. The aperture constitutes an outlet. A tangential extension is adapted to overlie the major component for creating a chamber. A rotatable assembly includes an annular plate. The annular plate has an aperture. Spaced impeller segments are provided. A propeller is also provided. The propeller has an axial bore. Propeller blades are provided. Openings are provided between the blades. The bore is adapted to receive a drive shaft of a motor. In this manner the propeller and the annular plate and the impeller segments are rotated.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a rotatable assembly of a centrifugal impeller/propeller system constructed in accordance with the principles of the present invention.

FIG. 2 is a front elevational view of centrifugal impeller/propeller system with the rotatable assembly of FIG. 1 constructed in accordance with the principles of the present invention.

The same reference numerals refer to the same parts throughout the various Figures.

DESCRIPTION OF THE PREFERRED EMBODIMENT

Figure 3:
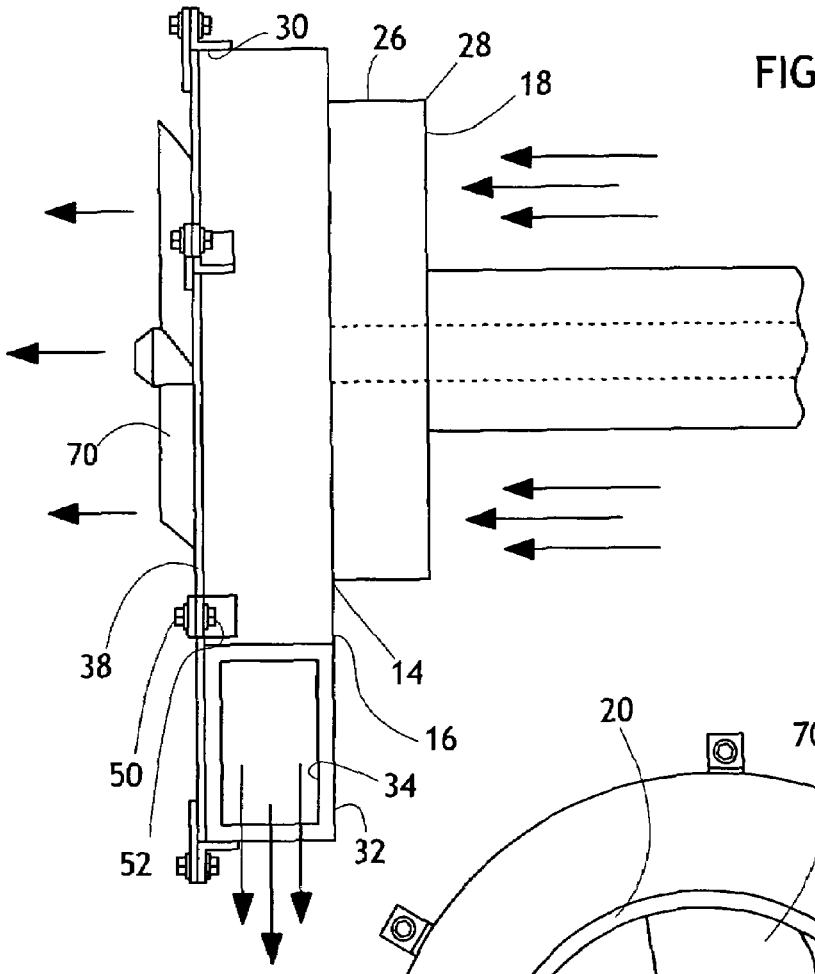
FIG. 3 is a right side elevational view of the system shown in FIG. 2.
Figure 4:
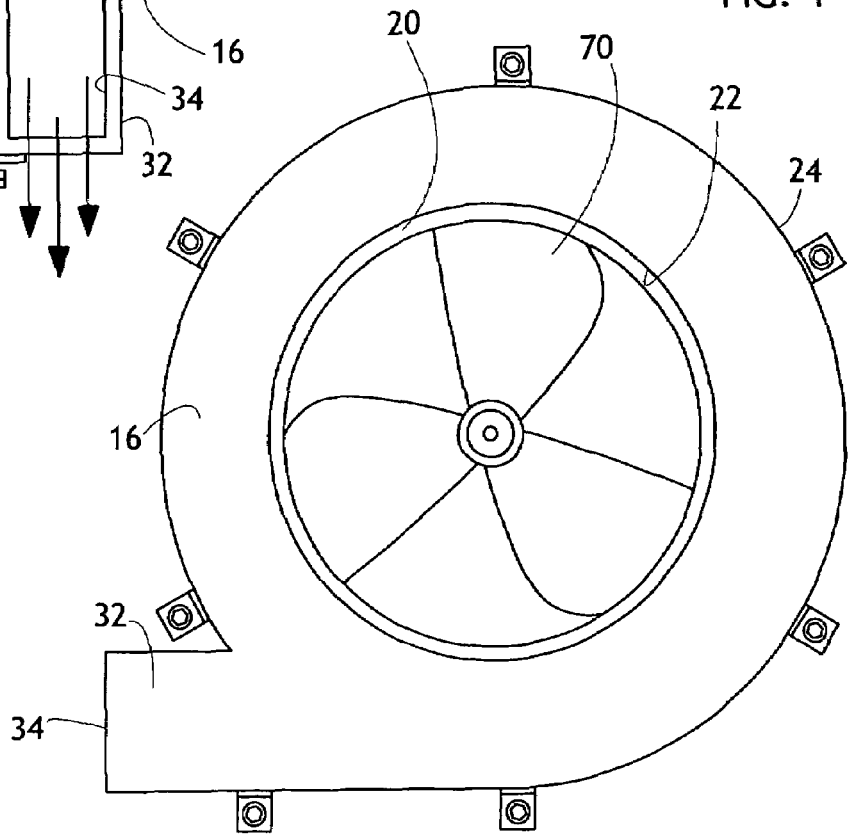
FIG. 4 is a rear elevational view of the system shown in FIG. 2.

With reference now to the drawings, and in particular to FIG. 1 thereof, the preferred embodiment of the new and improved centrifugal impeller/propeller pump system embodying the principles and concepts of the present invention and generally designated by the reference numeral 10 will be described.

The present invention, the centrifugal impeller/propeller pump system 10 is comprised of a plurality of components. Such components in their broadest context include a housing and a rotatable assembly. Such components are individually configured and correlated with respect to each other so as to attain the desired objective.

First provided is a housing 14. The housing includes a major component 16. The major component has a planar section 18. The planar section has a circular aperture 20 constituting an inlet. In this manner a radially interior periphery 22 and a radially exterior periphery 24 are formed. The major component also has a generally cylindrical peripheral section 26. The peripheral section has an axially interior edge 28. The interior edge is secured to the exterior periphery. The peripheral section also has a free axially exterior edge 30. The peripheral section and the planar section have a tangential extension 32. In this manner an outlet 34 is created.

The housing also includes a minor component 38. The minor component has a planar section 40. The planar section has a circular aperture 42. The circular aperture constitutes an outlet. Also in this manner a radially interior periphery 44 and a radially exterior periphery 46 are formed. The planar section has a tangential extension 48. In this manner the exterior periphery of the minor section is adapted to overlie the axially exterior edge of the of the major component. Further in this manner a generally cylindrical chamber is created between the major and minor components. Bolts 50 are provided. Nuts 52 are also provided. The bolts and nuts secure the major and minor components during operation and use.

Provided last is a rotatable assembly 56. The rotatable assembly includes an annular plate 58. The annular plate is positioned within the chamber adjacent the planar surface of the major component. The annular plate has a generally circular aperture 60. In this manner a radially interior periphery 62 and a radially exterior periphery 64 are formed. The annular plate has six arcuately shaped outstanding spaced impeller segments 66. The impeller segments are located within the chamber. The annular plate also has a propeller. The propeller has an axial bore 68. The propeller has three spaced propeller blades 70. Openings are provided between the blades. The propeller blades are located partially interior of the chamber and partially exterior of the chamber. The propeller blades extend through the circular aperture of the planar section of the minor component. The bore is adapted to receive a drive shaft of a motor. In this manner the propeller and the annular plate and the impeller segments are rotated. Further in this manner water will be drawn into the chamber through the aperture of the major component into contact with the impeller segments and the expelled from the chamber through the peripheral extension and the aperture of the minor component. Note the directions of the arrows in the Figures.

Figure 5:
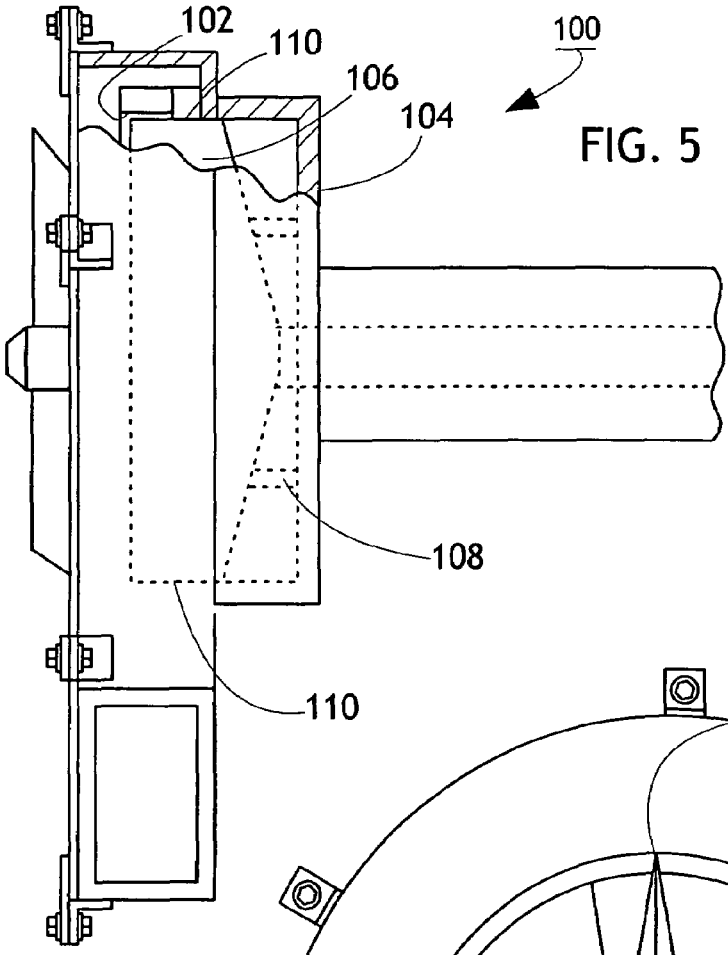
FIG. 5 is right side elevational view of the system similar to that shown in FIG. 3 but illustrating an alternate embodiment of the invention.
Figure 6:
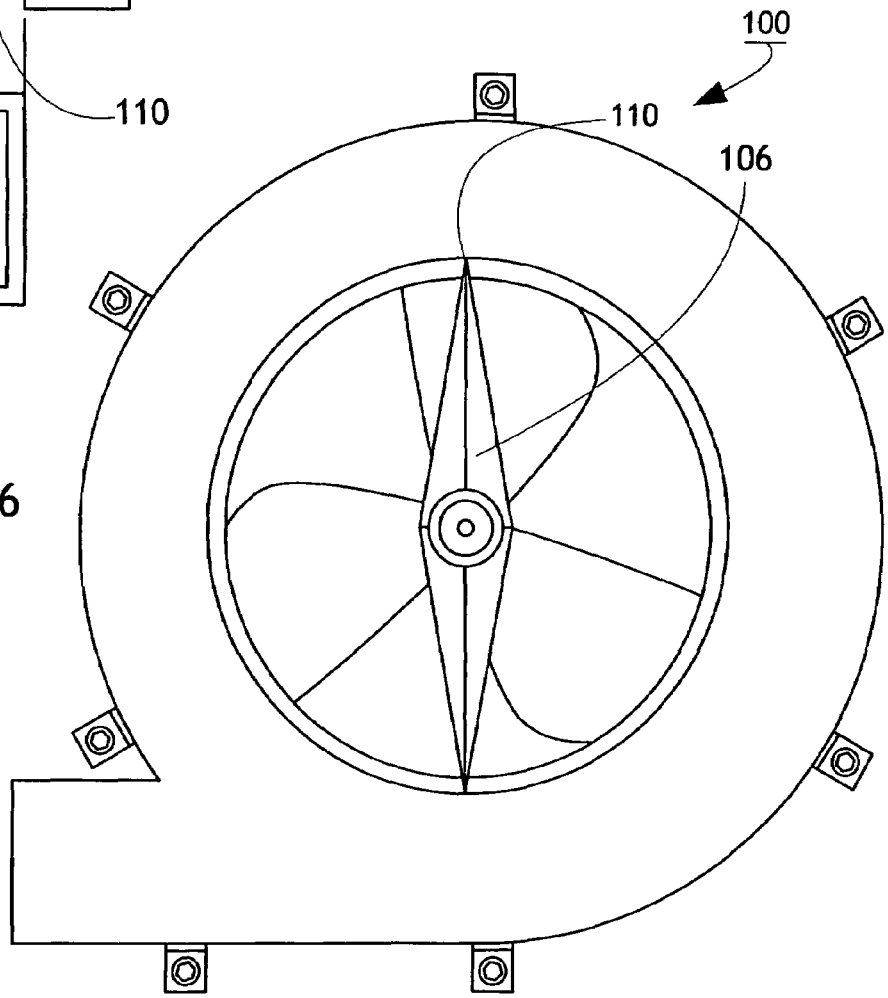
FIG. 6 is a rear elevational view of the system shown in FIG. 4 but illustrating the alternate embodiment of the invention.

Reference is now made to a system 100 constituting the alternate embodiment of the invention shown in FIGS. 5 and 6. The impeller segments have parallel, radially interior edges 102. The interior edges extend perpendicularly from the annular plate. A supplemental housing member 104 is provided. A cutter bar 106 is also provided. A backing component 108 is provided. The backing component is fixedly secured between to the supplemental housing member and the cutting bar. The cutting bar has two cutting edges 110. The cutting edges face radially outwardly. In this manner, in association with the radially interior edges of the impeller segments, a cutting action on suspended particular material in water passing through the system. The other components are essentially the same as in the prior embodiment.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A centrifugal impeller/propeller pump system comprising:

a housing including a major component having a planar section with an aperture constituting an inlet and a generally cylindrical peripheral section formed with a tangential extension constituting an outlet;

the housing also including a minor component having a planar section with an aperture constituting an outlet and formed with a tangential extension adapted to overlie the major component for creating a chamber; and a rotatable assembly including an annular plate with an aperture and spaced impeller segments and a propeller with an axial bore and propeller blades with openings between the blades, the bore adapted to receive a drive shaft of a motor for rotating the propeller and the annular plate and the impeller segments;

wherein the annular plate and impeller segments are positioned within the chamber with the propeller blades located partially interior of the chamber and partially exterior of the chamber and extending through the circular aperture of the planar section of the minor component.

2. A centrifugal impeller/propeller pump system for pumping liquids with suspended solids in a safe, efficient and economical manner comprising, in combination:

a housing including a major component having a planar section with a circular aperture constituting an inlet, the planar section forming a radially interior periphery and a radially exterior periphery, the major component also having a generally cylindrical peripheral section with an axially interior edge secured to the exterior periphery and a free axially exterior edge, the peripheral section and planar section being formed with a tangential extension creating an outlet;

the housing also including a minor component having a planar section with a circular aperture constituting an outlet and forming a radially interior periphery and a radially exterior periphery, the planar section being formed with a tangential extension whereby the exterior periphery of the minor section is adapted to overlie the axially exterior edge of the major component for creating a generally cylindrical chamber between the major and minor components with bolts and nuts securing the major and minor components during operation and use;

a rotatable assembly including an annular plate positioned within the chamber adjacent the planar surface of the major component with a generally circular aperture forming a radially interior periphery and a radially exterior periphery, the annular plate having six arcuately shaped outstanding spaced impeller segments located within the chamber, the annular plate also having a propeller with an axial bore and three spaced propeller blades with openings between the blades, the propeller blades located partially interior of the chamber and partially exterior of the chamber and extending through the circular aperture of the planar section of the minor component, the bore adapted to receive a drive shaft of a motor for rotating the propeller and the annular plate and the impeller segments whereby water will be drawn into the chamber through the aperture of the major component into contact with the impeller segments and the expelled from the chamber through the peripheral extension and the aperture of the minor component.

* * * * *